US006391236B1

(12) United States Patent
Franceschini

(10) Patent No.: US 6,391,236 B1
(45) Date of Patent: May 21, 2002

(54) PROCESS AND PLANT FOR FORMING CERAMIC TILES AND THE LIKE

(76) Inventor: Alberto Franceschini, No. 1, St. EL Saada, Roxy Heliopolis, 11352 Cairo (EG)

( * ) Notice: Subject to any disclaimer, the term of this patent is extended or adjusted under 35 U.S.C. 154(b) by 0 days.

(21) Appl. No.: 09/445,549

(22) PCT Filed: May 14, 1998

(86) PCT No.: PCT/IT98/00123

§ 371 Date: Dec. 9, 1999

§ 102(e) Date: Dec. 9, 1999

(87) PCT Pub. No.: WO98/56551

PCT Pub. Date: Dec. 17, 1998

(30) Foreign Application Priority Data

Jun. 10, 1997 (IT) ..... MO97A0107

(51) Int. Cl.[7] ..... B28B 13/02; B28B 1/16

(52) U.S. Cl. ..... 264/112; 264/113; 425/130; 425/257; 425/406

(58) Field of Search ..... 264/109, 112, 264/113; 425/257, 258, 406, 452, 453, 454, 130

(56) References Cited

U.S. PATENT DOCUMENTS 2,752,656 A * 7/1956 Rutgers
3,097,929 A * 7/1963 Ragan ..... 264/112
4,939,060 A * 7/1990 Goossens
5,056,998 A * 10/1991 Goossens ..... 264/113

FOREIGN PATENT DOCUMENTS

| | | | |
|---|---|---|---|
| EP | 0 300 532 | | 1/1989 |
| EP | 0 492 733 | | 7/1992 |
| EP | 0 558 248 | | 9/1993 |
| EP | 0 586 257 | | 3/1994 |
| EP | 0 822 044 0 | | 2/1998 |
| EP | 858 873 | * | 8/1998 |
| FR | 646 602 | | 11/1928 |
| FR | 2 239 853 | | 2/1975 |
| WO | 98/23424 4 | | 6/1998 |

* cited by examiner

*Primary Examiner*—Mathieu D. Vargot
(74) *Attorney, Agent, or Firm*—Browdy & Neimark, P.L.L.C.

(57) ABSTRACT

The process for forming ceramic tiles comprises depositing a layer of multi-coloured powdery material on a moving transport plane, in order to achieve a predetermined pattern, and subsequently transferring said layer internally of a moulding cavity, due to a movement of the transport plane and a contemporary displacement of the transport plane with respect to the cavity. The forming plant comprises a conveyor belt (2) able on command to perform displacements with respect to the forming cavity. A plurality of silk-screening devices (9) is predisposed to deposit a layer of powdery material bearing a predetermined design on the transport plane. The invention can be especially useful in the production of decorated vitrified stoneware tiles.

18 Claims, 3 Drawing Sheets

40
42
41
43
44

19
11
11a
16
13
14
15
16
11a
12
11

19
11
13
16
18
11
19
11a
13
16
18

Fig.6
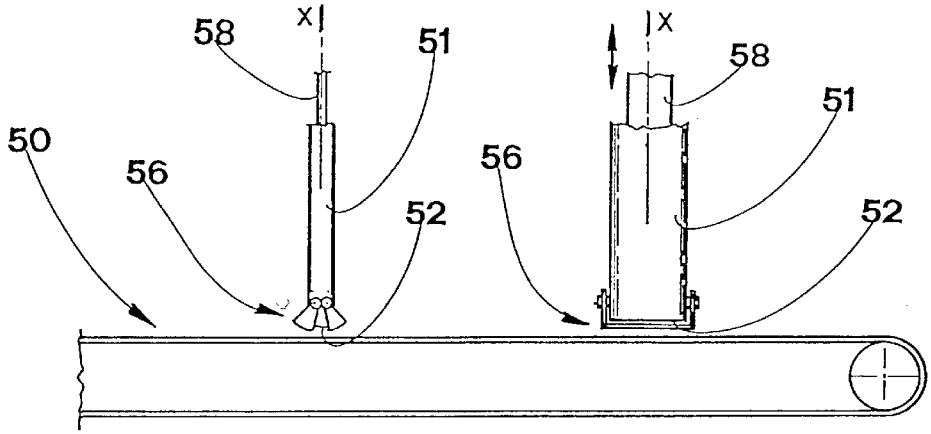
Fig.7
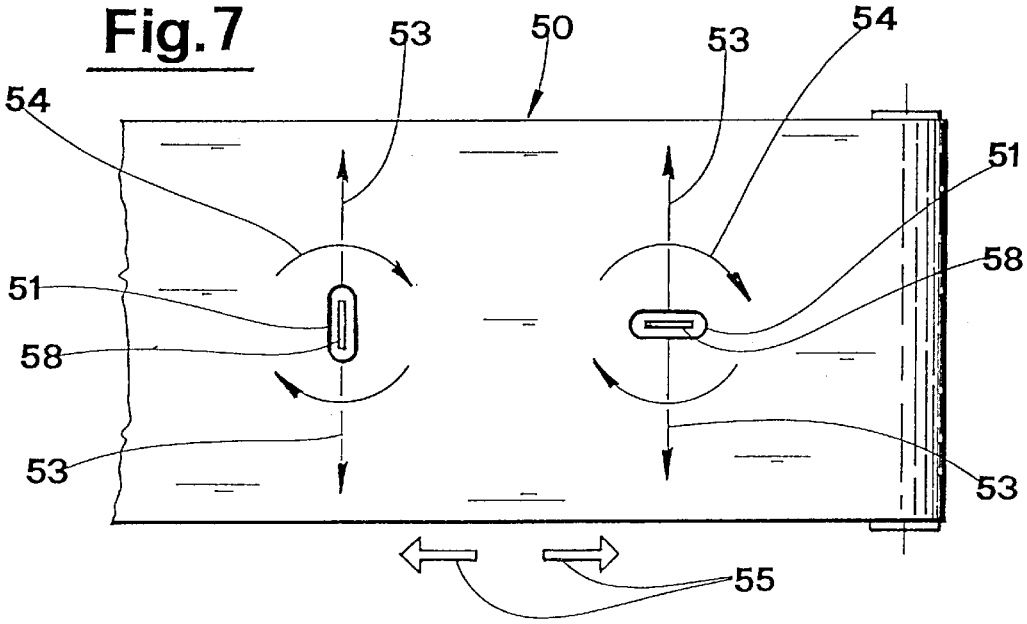
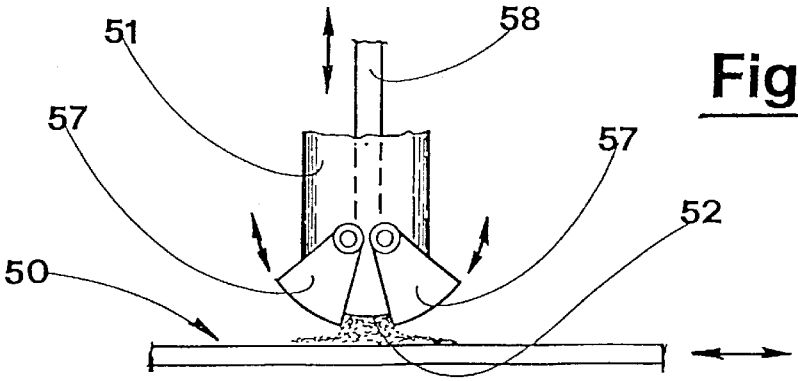
Fig.8

PROCESS AND PLANT FOR FORMING CERAMIC TILES AND THE LIKE

CROSS REFERENCE TO RELATED APPLICATION

The present application is the national stage under 35 U.S.C. 371 of PCT/IT98/00123, filed May 14, 1998.

TECHNICAL FIELD

The invention relates to a process and a plant for shaping ceramic tiles and the like. The invention is usefully employed in the field of decorated vitrified stoneware tile production and the like.

BACKGROUND ART

In particular the invention relates to a process for forming ceramic tiles and the like, comprising a first phase in which a layer of powdery material is deposited on a mobile transport plane, in such a way that the powdery material exhibits a pattern. In a second phase the layer of powdery material is transferred internally of a forming cavity of a mould by effect of a movement of the transport plane which causes the powdery material to fall from an edge of the transport plane and by effect of a contemporaneous displacement of the transport plane with respect to the cavity, so that the powdery material is caused to fall internally of the cavity and is deposited in the form of a layer and still exhibiting the pattern. In a third phase the powdery material deposited in the cavity is pressed.

A similar process is known from EP 0 492 733 or EP 0 300 532, wherein a pattern layer of ceramic material is deposited by moving a rotating belt over the forming cavity, on which belt the material of the pattern layer is present. In EP 0 492 733 striated colour patterns are formed in the upper surface of the tiles by means of a conveyor belt whose side receiving the powdery material is provided with grooves disposed in a desired arrangement, into which the material is introduced in order to be subsequently deposited from the grooves into the forming cavity of the mould.

The prior art comprises also EP 0 558 248, which discloses a method for producing ceramic patterned shaped articles, wherein dry particles for a pattern course are lodged in a plurality of spaces provided on an endless pattern-forming device. The supplied particles are temporarily retained in the spaces. Then the particles are released onto a given surface.

A main aim of the invention is to provide a process for forming ceramic tiles which economically and simply enables decorations to be made on tiles which are completely contained within the breadth of the tile itself.

An advantage of the invention is that it enables complex but well-defined multicoloured patterns to be made.

A further advantage is that decorations are obtained on the tiles which reproduce the exterior aspect of stone slabs.

A further aim of the invention is to provide a plant for realising the above process.

These aims and advantages and more besides are achieved by the invention, as it is characterised in the appended claims.

The process of the invention comprises a first phase, wherein a layer of powdery material is deposited on a running conveyor surface. The layer of powdery material is multicoloured so as to give the layer a predetermined pattern or decoration. This is followed by a second phase wherein the deposited powder is transferred into a shaping cavity of a mould, by effect of a movement of the conveyor, which tips the powder from an edge of the conveyor itself; the powder being caused to fall into the cavity, maintaining however the pattern of before. There then follows a third phase in which the powder is pressed in the shaping cavity, before which, if so desired, the powder can be screeded in the cavity. The layer of powdery material formed on the conveyor surface and bearing the decoration is preferably screeded, using means of known type, even before being transferred into the shaping cavity.

In a preferred embodiment of the invention, the first abovementioned phase, in which a decoration in the powder itself is achieved, is preceded by a number of operations in sequence, as follows: filling one or more shaped cavities distributed on a surface according to a predetermined design or decoration; compacting the powder material internally of said cavities; transferring the compacted material on to the moving conveyor, so that the surface of the conveyor is covered with a decorated layer of compacted material, on which more powder material is deposited, not compacted, and either of one colour or several, which second layer covers the decorative compacted material all of which is then deposited in the shaping cavity. The non-compacted material can be deposited on the conveyor before the compacted layer, if so desired, the whole then being deposited in the forming cavity.

The distribution of the powder on the conveyor can be done so that the more aesthetically appealing face, i.e. the one bearing the decoration, is the lower face, but the opposite can also be achieved. The tile can be achieved with the more attractive surface facing either downwards or upwards.

In the above-described process the decoration is included in the powder material before pressing and can be realised, at least partially, using pre-compacted material, which determines very special decorative results in the finished tile, reproducing the natural look of stone materials, such as marble, for example.

In another embodiment of the above-described process, a fraction of the compacted material forming the decoration arranged on the conveyor surface can be broken. Said fraction of the material, due to the, effect of the breaking, is detached from the part of the material which remains compacted and is arranged haphazardly at the edge of the compacted material. This technique gives the finished tiles an ornamental effect which is very similar to the irregularities normally found in stone materials.

The material used for making the tiles is preferably constituted by a mixture or granules or powders, which, after firing, results in a product having the characteristics of vitrified stoneware.

If so desired, a part of the tile breadth can be made using less aesthetically attractive powder; obviously the lower part, including the bottom surface, would normally be the one made with this less attractive material.

After firing, the more attractive of the two faces can be further processed by sanding and buffing.

The invention provides a decoration contained within the tile itself, as it exits from the mould and without any need to add material on the surface of the tile. Very detailed and well-defined patterns and colours can be obtained on vitrified stoneware tiles using the above-described process, without especially complicating the production cycle. The process also offers the possibility of obtaining patterns which very greatly imitate the natural appearance of marble and granites. The invention also enables production of tiles having the type of decoration known as "textured", i.e. with parts of the surface in relief, which can then be sanded away or left, as so desired.

Further characteristics and advantages of the present invention will better emerge from the detailed description that follows of some preferred but non-exclusive embodiments of plants for realising the above-described process, illustrated purely by way of non-limiting examples in the accompanying figures of the drawings, in which:

FIG. 6 shows a detail of a further embodiment of the plant in a vertical-elevation side view;

FIG. 7 is a plan view from above of FIG. 6;

FIG. 8 is a detail of FIG. 6 in enlarged scale.

DISCLOSURE OF INVENTION

Figure 1:
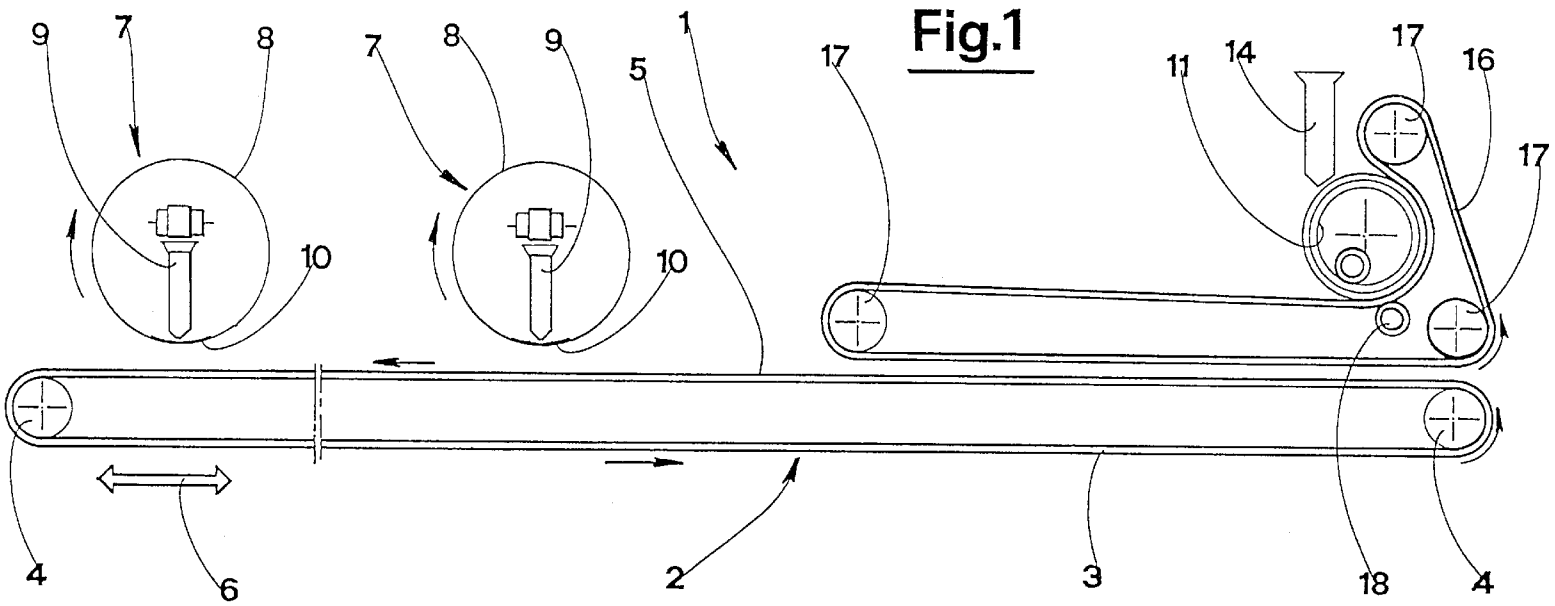
FIG. 1 shows a schematic side view in vertical elevation of a part of the plant in a first embodiment thereof.

With reference to the above-mentioned figures from 1 to 3, 1 denotes in its entirety a loading device for loading a ceramic tile mould with powder material. The mould, of known type and not illustrated, can be actuated by a press and is provided with a shaping cavity destined to be filled with powder material for pressing.

The loading device 1 comprises a conveyor 2 having a closed belt 3 ring-wound about pulleys 4 and provided superiorly with a flat and horizontal transport surface 5.

The conveyor belt 2 can on command perform movements relative to the mould forming cavity. In particular the conveyor 2 can be translated in a horizontal direction, indicated by the arrow 6 in FIG. 1, in both directions.

At least one silk-screening device 7 is predisposed above the mobile transport plane 5, which silk-screening device 7 can deposit on the plane a layer of powdery material bearing a predetermined design or decoration. In the present example two rotary silk-screening devices 7 are shown, operating one after the other on the transport surface 5. A different number of silk-screening devices, of another type too, could be used instead.

In the example shown in FIG. 1, each silk-screening device 7 comprises a cylindrical rotary screen 8 internally of which is situated a hopper 9 for feeding the powder material. One or more sections 10 of the screen 8 are preferably closed, letting no powder pass through. The length of the sections 10 depends mainly on the shape of the tile to be made.

The layer of dust bearing the decoration can be deposited by moving the belt 3 under the silk screening devices 7, while the devices 7 themselves deposit the dust in such a way that the dust laid by a screen 8 is superposed on the dust laid by a previous screen 8. Means for regulating the advancement speed of the belt 3 are provided, so that the thickness of the material deposited on the belt through the screens 8 can be controlled.

The silk-screening devices 7 can move transversally with respect to the advancement of the belt 3. In use, therefore, the dust can be deposited while the screens 8 themselves are moved transversally, which enables special decorations to be achieved.

A hollow drum 11 is predisposed above the conveyor belt 2, upstream of the silk-screening devices; the drum 11 is rotatable in the direction indicated by the arrow 12, has a horizontal axis, and exhibits cavities 13 on its external surface, distributed according to a predetermined design. A hopper 14 discharging powdery material operates on the external surface 11*a* of the hopper 11, filling the cavities 13. A scraper 15 can be provided to remove excess powder from the surface 11*a* of the drum 11, leaving only the powder contained in the cavities 13. A part of the external surface 11*a* of the drum 11 is wound about by a belt 16 which is ring-wound or slidable on rollers or pulleys 17. The belt 16 holds the material inside the cavities 13, preventing exit therefrom.

A first roller 18 with a tamping function operates on the external surface 11*a* of the drum 11 so as to compress the powder in the cavities 13. The belt 16 is forced to pass between the drum and the tamper roller 18. When a cavity 13, full of powder, passes below the tamper roller 18, the material therein is compacted (see FIG. 2).

Figures 2, 3, 5:
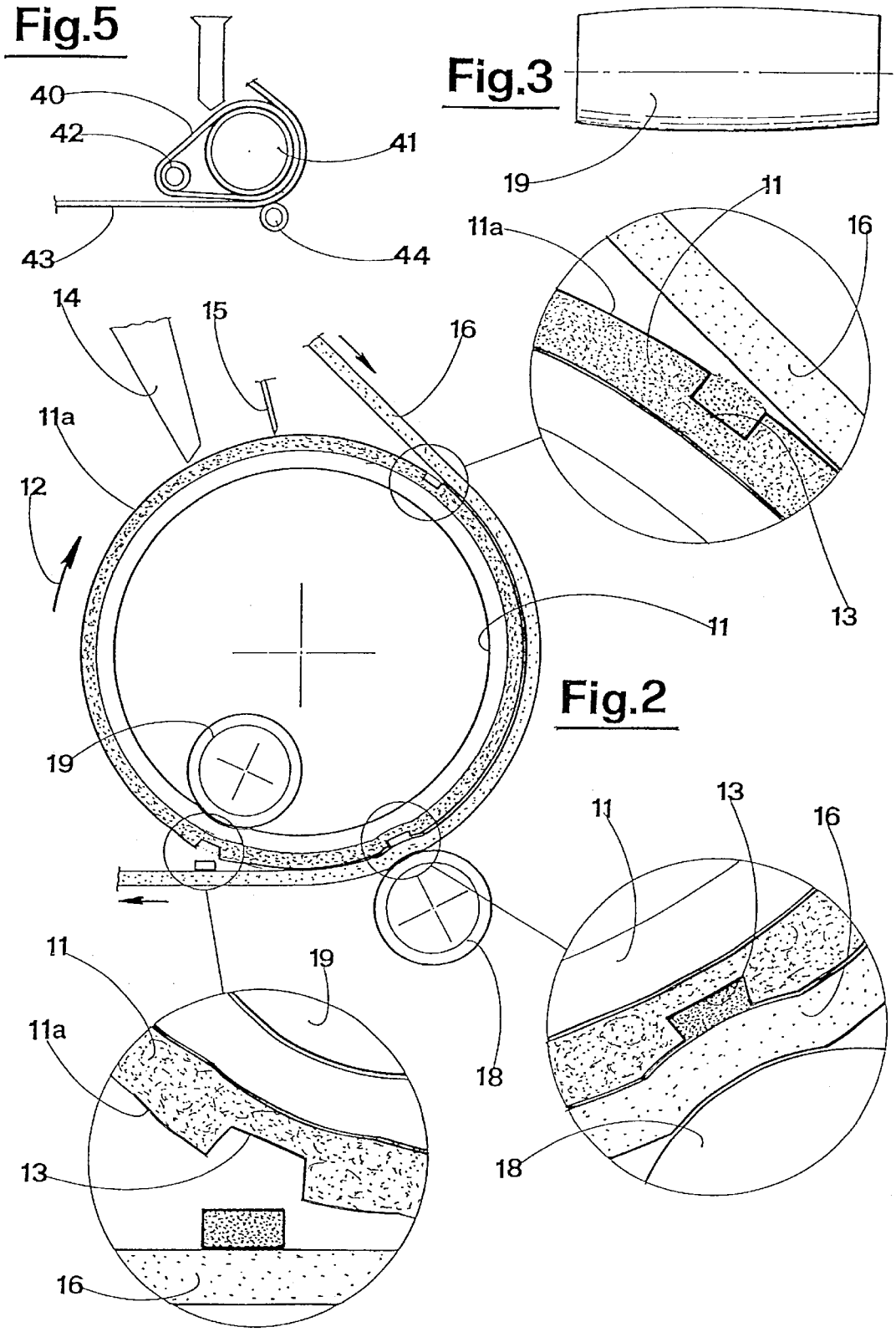
FIG. 2 is an enlarged-scale detail of FIG. 1.
FIG. 3 shows a roller of FIG. 1, in a frontal view.
FIG. 5 shows a detail of a third embodiment of the plant.

A second roller 19, having an expelling function, operates internally of the drum 11 to press the surface of the drum outwards, favouring the release of the powder contained in the cavities 13 above the belt 16. During the rotation of the drum 11, when a full cavity passes in proximity of the expeller roller 19, the compacted material inside is deposited on the belt 16. Thus a shaped decorated or patterned compacted material is deposited on the belt 16. Both the tamper 18 and the expeller 19 are preferably convex is shape, as shown in FIG. 3.

The belt 16, which moves continuously, deposits the design on the upper transport surface 5 of the conveyor belt 2.

The compacted material, by effect of the transport surface 5 advancement, passes below the silk-screening devices 7, which deposit on the powder material a layer of powdery material which may exhibit another predetermined design or decoration. A screed, of known type and not illustrated, can operate on the transport surface 5, after the silk-screening devices, to level the layer of powdery material deposited on the surface.

The shaping cavities of the mould will be filled by causing the abovementioned layer to fall from the edge of the transport surface by effect of the movement of the surface itself and a contemporaneous movement of the conveyor belt 2 with respect to the shaping cavities.

Figure 4:
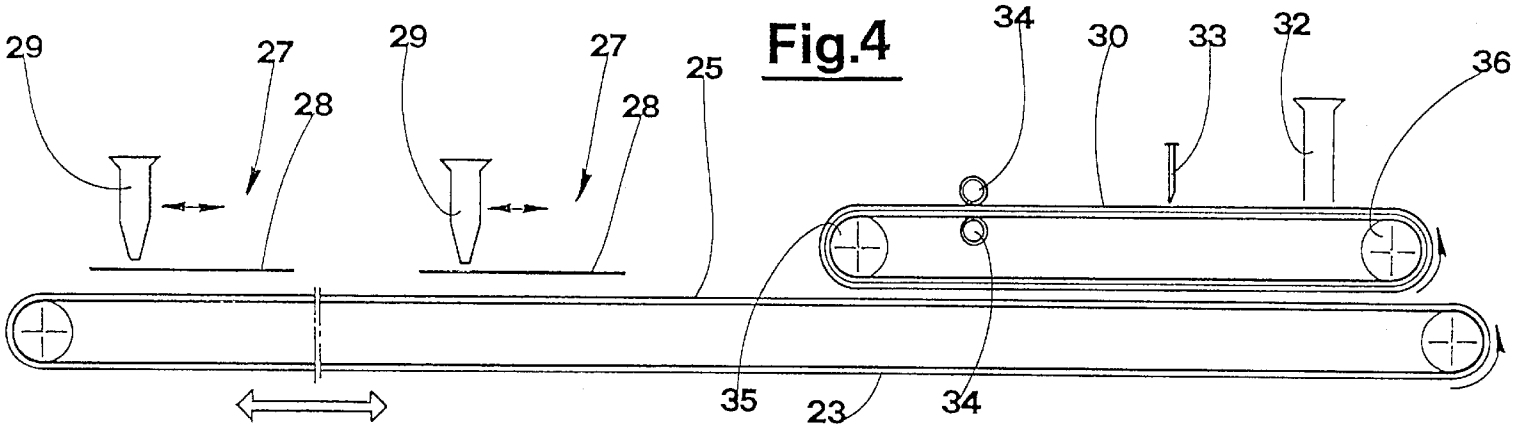
FIG. 4 shows a second embodiment of a part of the plant.

Once the shaping cavity is filled, the powders are pressed to produce an unfired tile whose better surface, which will be the face of the tile, will be the product of a pattern that is not merely superficial but which is contained within the breadth of the tile itself In FIG. 4 a second embodiment of the invention is shown, in which at least one silk screening device 27 is provided with a flat screen 28. A horizontally-mobile hopper 29 distributes the powder. The material can be deposited through the screen 28 both with the belt 23 still and the hopper 29 in movement and with both the belt 23 and the screen 28 in movement.

In the example of FIG. 4 the blind cavities, where the tamping of at least a part of the decoration is carried out, are made on a belt 30 wound on pulleys 35 and 36 and comprising an upper horizontal tract on which a hopper 32 deposits powdery material. A scraper 33 can be provided to remove excess powder, leaving only the powder inside the cavities. In this case the tampers, which tamp the powder down in the cavities, comprise two counterposed rollers 34 between which the belt 30 is made to move. The expellers, which transfer the compacted design on to the transport surface 25, are realised using the same pulley 35 about which the belt 30 affording the cavities is wound. The pulley 35 is preferably convex, like the roller 19 of FIG. 3, while the other pulley 36 is preferably concave at its centre.

In a third embodiment of the invention shown in FIG. 5, means for transferring the compacted powder from the cavities to the conveyor belt. In this case a belt 40, bearing the cavities in which the powder which will form the final pattern is tamped down, is wound on a drum 41 which is rotatable on command, and an idle roller 42 is predisposed between said belt 40 and the drum 41. The belt 40 runs on the roller 42 which is distanced from the drum 41. A further belt, denoted by 43, partially winds about the drum 41 and the belt 40. The belt 43 carries out essentially the same functions as the belt 16 of FIG. 1. A tamping roller 44 compresses the powder previously deposited in the cavities of the belt 40. The action of the roller 42 on the belt 40 favours the release of the compacted powder and its laying on the underlying belt 43.

Figures from 6 to 8 show means for depositing powder material on a conveyor belt 50, in a further embodiment of the invention. The means comprise one or more distribution conduits 51, arranged one after another, each having an oblong outlet mouth 52 situated above the belt 50. Each conduit 5, which extends more or less vertically, can perform on command a movement in a transversal direction 53 to the advancement direction of the belt 50, as well as a rotation movement, shown by arrow 54, about a vertical longitudinal axis x, so that the outlet mouth 52 can be oriented selectively with respect to the advancement direction of the belt. If the outlet mouth 52 is arranged with the longer part directed the same as the advancement direction of the belt, the powder which exits from the mouth will be deposited on the belt so that it occupies a fairly narrow space thereon, while if the outlet mouth 52 is arranged with the longer sides directed perpendicular to the belt advancement direction, the deposited powder will occupy a wider space thereon. Thus, simply by rotating the conduit it is possible to vary the width of the powder deposited on the belt, obtaining a varied decoration which, on the finished tiles, recalls the appearance of a natural stone slab.

Each distribution conduit 51 is provided, at the outlet mouth 52, with means for intercepting the powder, by means of which the delivery rate of the powder can be controlled at the outlet. The means for intercepting can comprise a mobile obturator 57 which on command can control the section of the passage through which the powder has to pass on exit from the conduit 51. An oscillating blade 58 is arranged internally of the conduit 51 and can be commanded to move alternatingly in a vertical direction, thus preventing blockage of powders in the conduit 51. The conveyor belt 50 can perform controlled movements in both directions.

The control of the belt 50 serves to produce infinite combinations of patterns and decorations in the powders thanks to the equally infinite movements the belt and the conduits 51 are capable of. The means for controlling, of known type and not illustrated, synchronically govern both the belt drive and the conduit 51 movement organs. During functioning the decoration is in fact created by predetermined sequences of movement of the conduits 51 (lateral displacements either to the left or right, and rotations in both directions about respective longitudinal axes x) and the belt 50 (running forwards or backwards).

What is claimed is:

1. A process for forming ceramic tiles comprising:

depositing a layer of powdery material on a mobile transport plane;

transferring said layer of powdery material to a mold cavity of a forming mold by movement of said transport plane which causes the powdery material to fall from an edge of the transport plane, and by a contemporaneous displacement of said transport plane with respect to the mold cavity, so that said powdery material is caused to fall into the mold cavity and is deposited in the form of a layer, the layer of powdery material deposited in said mold cavity including a pattern of compacted powdery material and a further layer of non-compacted powdery material;

pressing the powdery material deposited in said mold cavity; and wherein the compacted pattern is obtained by:

filling one or more shaped pattern cavities distributed on an endless moving surface according to a predetermined design or decoration with powdery material;

compacting the powdery material internally of said pattern cavities; and releasing the compacted powder contained in the pattern cavities and transferring it to the mold cavity.

2. The process of claim 1, wherein the compacted powder contained in the pattern cavities is released above the mobile transport plane and then is transferred to the mold cavity.

3. The process of claim 1, wherein the powdery material in the pattern cavities is compacted during the movement of said surface when the surface, with the pattern cavities full of powder, passes between two opposite tamper rollers.

4. The process of claim 1, wherein said endless moving surface is an external surface of a rotatable drum.

5. The process of claim 4, wherein the release of the compacted powder contained in the pattern cavities is performed by pressing the surface of the drum outwards.

6. Apparatus for forming ceramic products, comprising:

a mold having a shaping cavity to be filled with powdery material;

press means to shape the powdery material;

a loading device for the mold comprising:

at least one conveyor belt performing displacements with respect to said shaping cavity, and means for depositing on said conveyor belt a layer of powder material bearing a predetermined pattern, said shaping cavity during functioning receiving said layer of powder material from the conveyor belt by gravity and by operating of the conveyor belt and a displacement of the conveyor belt with respect to the shaping cavity;

said means for depositing on said conveyor belt a layer of powder material comprising:

an endless moving surface having one or more pattern cavities;

means for filling said pattern cavities with powdery material destined to form a pattern of the ceramic product;

means for compacting said powdery material in said pattern cavities;

means for transferring the compacted material from the surface having the pattern cavities to the conveyor belt; and means for laying further uncompacted powdery material on said compacted patterned material.

7. The apparatus of claim 6, wherein said means for laying comprises at least one silk-screening device (7, 27).

8. The apparatus of claim 6, wherein said means for compacting comprises at least one pressing roller for pressing against said surface having cavities.

9. The apparatus of claim 6, wherein said means for transferring comprises an element which operates internally of said surface having pattern cavities and flexes said surface having pattern cavities externalwise.

10. The apparatus of claim 9, wherein said element comprises a roller (19) internal of and tangential to a drum (11), an external surface (11*a*) of which drum (11) contains said cavities (13.

11. The apparatus of claim 9, wherein said surface having said pattern cavities (40) is at least in part wound on a rotating drum (41) and that said element (42) is arranged between said surface having pattern cavities (40) and said drum (41).

12. The apparatus of claim 6, wherein said surface having pattern cavities (30) is wound about pulleys (35, 36).

13. The apparatus of claim 6, wherein said means for filling comprises a hopper (14, 32) for unloading the powdery material on said pattern cavities (13) and a scrapper (15, 33) for removing excess material.

14. The apparatus of claim 6, wherein said means for depositing comprises at least one distribution conduit (51) for the powdery material, provided with at least one outlet mouth (52) situated above the transport plane (50) and further able to move in a transverse direction to the advancement direction of the transport plane.

15. The apparatus of claim 14, wherein said outlet mouth (52) is oblong and said conduit (51) is able to rotate so as to vary an orientation of the outlet mouth (52) with respect to a movement direction of the conveyor belt.

16. The apparatus of claim 6, wherein said means for laying comprises a plurality of self-screening devices (7, 27) for operating one after another on said transport plane in order to deposit several layers, one laid on top of another.

17. The apparatus of claim 10, wherein said surface having said pattern cavities (40) is at least in part wound on a rotating drum (41) and that said element (42) is arranged between said surface having pattern cavities (40) and said drum (41).

18. The apparatus of claim 9, wherein said means for depositing comprises at least one distribution conduit (51) for the powdery material, provided with at least one outlet mouth (52) situated above the transport plane (50) and further able to move in a transverse direction to the advancement direction of the transport plane.

* * * * *